US007555236B2

(12) United States Patent
Saeki

(10) Patent No.: US 7,555,236 B2
(45) Date of Patent: Jun. 30, 2009

(54) IMAGE FORMING METHOD AND APPARATUS FOR EFFECTIVELY PERFORMING A CLEANING OPERATION OF A TRANSFER MEMBER

(75) Inventor: Kazuchika Saeki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 434 days.

(21) Appl. No.: 11/452,969

(22) Filed: Jun. 15, 2006

(65) Prior Publication Data

US 2006/0285873 A1 Dec. 21, 2006

(30) Foreign Application Priority Data

Jun. 15, 2005 (JP) ..... 2005-175757

(51) Int. Cl.
*G03G 15/16* (2006.01)

(52) U.S. Cl. ..... 399/101; 399/66

(58) Field of Classification Search ..... 399/43, 399/45, 66, 101
See application file for complete search history.

(56) References Cited

U.S. PATENT DOCUMENTS

| | | | | |
|---|---|---|---|---|
| 5,717,981 | A | 2/1998 | Yamanaka | |
| 5,999,763 | A * | 12/1999 | Hiroshima et al. | 399/66 |
| 6,223,008 | B1 * | 4/2001 | Takahashi et al. | 399/66 |
| 6,336,025 | B1 | 1/2002 | Saeki | |
| 6,487,387 | B2 * | 11/2002 | Kusaba et al. | 399/101 X |
| 7,127,191 | B2 * | 10/2006 | Mori et al. | 399/101 |
| 7,162,178 | B2 * | 1/2007 | Takiguchi et al. | 399/101 |
| 2005/0047816 | A1 | 3/2005 | Uchida et al. | |
| 2006/0056884 | A1 | 3/2006 | Sawai et al. | |

FOREIGN PATENT DOCUMENTS

| | | |
|---|---|---|
| JP | 5-27605 | 2/1993 |
| JP | 6-314035 | 11/1994 |
| JP | 2557710 | 9/1996 |
| JP | 2002-49275 | 2/2002 |
| JP | 2002-72713 | 3/2002 |

OTHER PUBLICATIONS

U.S. Appl. No. 11/934,981, filed Nov. 5, 2007, Furuya, et al.
U.S. Appl. No. 11/739,391, filed Apr. 24, 2007, Yokokawa et al.

* cited by examiner

*Primary Examiner*—Sandra L Brase
(74) *Attorney, Agent, or Firm*—Oblon, Spivak, McClelland, Maier & Neustadt, P.C.

(57) ABSTRACT

An image forming apparatus includes an image bearing member configured to bear an image on a surface thereof, a transfer unit configured to transfer the image formed on the surface of the image bearing member onto a recording medium, a bias applying unit configured to apply a bias voltage to the transfer unit to remove a developer adhered on a surface of the transfer unit to the surface of the image bearing member, a detecting unit configured to detect a width of the recording medium in a sheet conveyance direction, and a control unit configured to determine whether a cleaning operation of the transfer unit is performed, based on the width of the recording medium detected by the detecting unit and a number of the recording medium printed.

17 Claims, 7 Drawing Sheets

IMAGE FORMING METHOD AND APPARATUS FOR EFFECTIVELY PERFORMING A CLEANING OPERATION OF A TRANSFER MEMBER

CROSS REFERENCE TO RELATED APPLICATIONS

The present application claims priority to Japanese patent application no. 2005-175757, filed in the Japan Patent Office on Jun. 15, 2005, the disclosure of which is incorporated by reference herein in its entirety.

BACKGROUND OF THE INVENTION

1. Field of the Invention

The present invention relates to an image forming method and apparatus for performing a cleaning operation of a transfer member. More specifically, the present invention relates to an electrophotographic image forming apparatus such as a copier, printer, facsimile machine and so forth, in which a transfer voltage applying unit performs a cleaning operation of a transfer member to remove developer from the transfer member, and a method of performing a cleaning operation.

2. Discussion of the Related Art

It is well known that background image forming apparatuses have used a non-contact type corona discharging unit that serves as a transfer unit transferring a toner image formed on an image bearing member onto a transfer medium. For corona discharging, however, the transfer unit needs to be applied with a high voltage, which can produce ozone of high concentration. To avoid the production of ozone of high concentration, background image forming apparatuses employing a transfer method in which a bias voltage is directly applied to a back side of a recording medium have been increasing in recent years. The above-described contact type transfer method uses less voltage than that used for a corona discharging unit, and therefore, produces a less amount of ozone. Further, since a recording medium receives a toner image while being held in contact between a contact type transfer unit and an image bearing member, the recording medium is closely attached to the image bearing member with high adherence.

In the above-described background image forming apparatus employing the contact type transfer method, however, the contact type transfer unit directly contacts the image bearing member, and therefore, toner used for forming a toner image on the image bearing member may adhere to the transfer unit. For example, when a paperjam occurs at an upstream portion in a sheet conveyance direction of a transfer nip portion where the image is transferred onto the recording medium, a toner image formed on the image bearing member can reach the transfer nip portion but the recording medium cannot due to the paper jam. On the other hand, the toner used for the toner image formed on the image bearing member may be conveyed to the transfer nip portion and may be directly transferred onto the contact type transfer unit. In this case, it is possible that the toner directly transferred onto the contact type transfer unit can contaminate the back side of a next recording medium and/or can change a value of a resistance voltage of the contact transfer unit, which may cause a partial transfer failure.

Specifically, when a full color printer forms a plurality of toner layers on a transfer member, a large amount of toner adhered to a contact type transfer unit may cause a great adverse effect to toner contamination on the back side of a recording medium.

To prevent the problem described above, some techniques have been proposed.

In one technique, a cleaning unit performs a cleaning operation by contacting a cleaning blade and/or a fur brush included therein with a contact type transfer unit. The above-described cleaning unit that is held in contact with the transfer unit can constantly perform a cleaning operation with respect to the contact type transfer unit, therefore, there is no need to include a sequence such as a cleaning mode. However, the above-described contact type cleaning method using the cleaning blade and fur brush to be held in contact with the transfer unit may cause following problems.

Since the cleaning blade is constantly held in contact with the contact type transfer unit, an edge portion of the cleaning blade can easily wear. For maintaining the cleaning ability of the cleaning unit, the cleaning blade by itself or with its peripheral members may need to be replaced constantly. Further, if the friction coefficient of the surface of the contact type transfer unit increases, the cleaning blade may be curled.

To resolve the above-described problem, another image forming apparatus has employed a technique wherein a lubricant is applied to coat a portion outside an image forming area. The technique works well to prevent curling of an edge portion of a cleaning blade, but cannot help prevent wear of the cleaning blade contacting the image forming area.

Another image forming apparatus, which does not use a lubricant, employs a technique wherein a toner image is formed on a non-image forming area to prevent curling of a cleaning blade so as to utilize the oil content in the toner serving as a lubricant. However, the technique contributes to an increase of toner consumption to waste unused toner, which may not be economical.

There is another image forming apparatus employing a technique that does not employ the above-described contact type cleaning method. When a recording medium is not positioned on a transfer portion, a transfer unit rotates at least one cycle, and at the same time, a voltage having a predetermined polarity is applied to the transfer unit. Further, when the transfer unit rotates at least another cycle, a voltage having a polarity opposite to the predetermined polarity is applied to the transfer unit.

In another image forming apparatus using a technique wherein when a cleaning operation of a transfer roller is performed, the polarity of a cleaning bias is switched between positive charge and negative charge.

Further in another image forming apparatus using a technique wherein the polarity of a cleaning bias to be applied to a transfer roller can be switched while a cleaning unit and a developing unit are started and before a transfer medium reaches a transfer portion at the start of an image forming operation.

However, in the above-described techniques, the polarity of a bias voltage is switched, and then the transfer roller is rotated one or more cycles to be applied with a bias voltage at each job. The above-described operation requires a great amount of period of time in total to be applied with a bias voltage, which can contribute to deterioration of productivity.

SUMMARY OF THE INVENTION

The present invention has been made in view of the above-described circumstances.

An object of the present invention is to provide an image forming apparatus that can efficiently remove developer from a transfer member.

Another object of the present invention is to provide a method of removing developer from the transfer member included in the image forming apparatus.

In one embodiment, an image forming apparatus includes an image bearing member configured to bear an image on a surface thereof, a transfer unit configured to transfer the image formed on the surface of the image bearing member onto a recording medium, a bias applying unit configured to apply a bias voltage to the transfer unit to remove a developer adhered on a surface of the transfer unit to the surface of the image bearing member, a detecting unit configured to detect the width of the recording medium in a sheet conveyance direction, and a control unit configured to determine whether a cleaning operation of the transfer unit is performed, based on the width of the recording medium detected by the detecting unit and the number of the recording medium printed.

The transfer unit may be configured to contact a back side surface of the recording medium and to be applied with a predetermined amount of bias voltage by the bias applying unit so that the image formed on the surface of the image bearing member is transferred onto a front side surface of the recording medium.

The cleaning operation may include a first cleaning operation performed at the start of an image forming operation of a job and a second cleaning operation performed at the end of the image forming operation of the job, and at least one of the first and second cleaning operations may be performed when the recording medium has a width smaller than a maximum width of image forming area of the image forming apparatus.

The transfer unit may include a rotatable elastic roller.

The transfer unit may include a rotatable endless belt.

The developer may be a polymerized toner prepared by a polymerization method.

The developer may have a first shape factor SF-1 in a range of approximately 100 to approximately 180 and a second shape factor SF-2 in a range of approximately 100 to approximately 180.

The image bearing member may be configured to bear a plurality of images, and the transfer unit may include an intermediate transfer member, a primary transfer unit configured to sequentially transfer the plurality of images onto a surface of the intermediate transfer member, and a secondary transfer unit configured to contact a back side surface of the recording medium and to be applied with a predetermined amount of bias voltage so that the plurality of images transferred and overlaid on the surface of the intermediate transfer member is transferred onto a front side surface of the recording medium.

The cleaning operation may include a first cleaning operation performed at the start of an image forming operation of a job and a second cleaning operation performed at the end of the image forming operation of the job, and at least one of the first and second cleaning operations may be performed for the secondary transfer unit when the recording medium has a width smaller than a maximum width of image forming area of the image forming apparatus.

The image bearing member may include an electrostatic latent image bearing member configured to bear a single toner image, and the intermediate transfer member may be configured to be rotated for a plurality of times to receive the plurality of images by one image after another from the image bearing member so that a full color image is formed thereon.

The electrostatic latent image bearing member may include a plurality of electrostatic latent image bearing members configured to bear respective single color images so that the full color image is formed thereon.

The intermediate transfer member may include an endless belt having single layer thereon.

The intermediate transfer member may include an endless belt having a plurality of layers thereon.

The intermediate transfer member may include an intermediate transfer drum.

Further, in one embodiment, a method of performing a cleaning operation with respect to a transfer unit includes detecting a width of a recording medium, comparing the width of the recording medium with a width previously stored in a memory, counting the number of the recording medium printed, determining whether the cleaning operation of the transfer unit is performed based on results of the comparing and counting, and applying a bias voltage when the cleaning operation is performed according to a result of the determining.

The above-described method may further include performing at least one of a first cleaning operation performed at the start of an image forming operation of a job and a second cleaning operation performed at the end of the image forming operation of the job when the recording medium has a width smaller than a maximum width of image forming area of the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
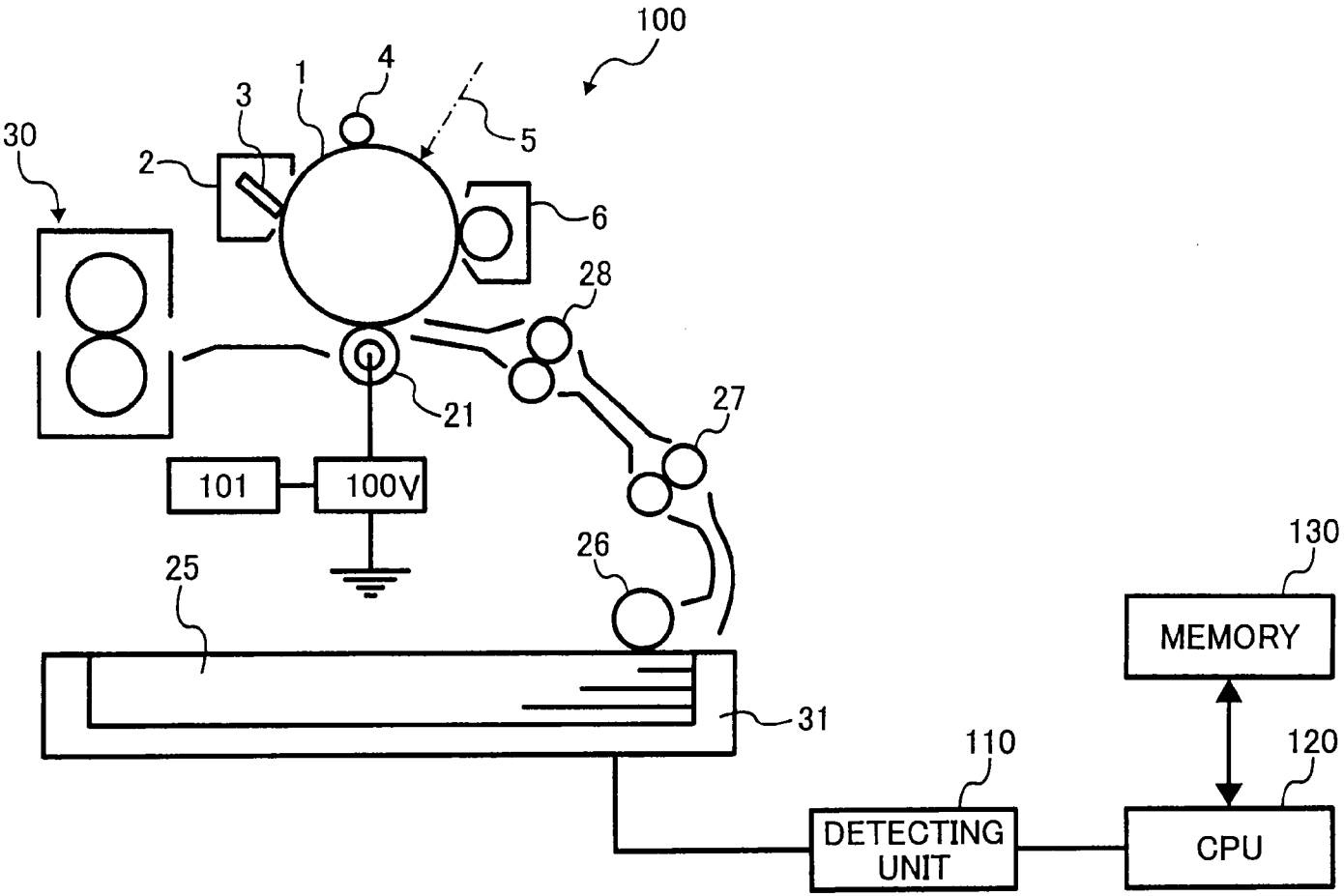
FIG. 1 is a cross sectional view of a schematic structure of an image forming apparatus according to a first example embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

First Example Embodiment

Referring to FIG. 1, the schematic structure of an image forming portion of an image forming apparatus 100, which is a laser printer, according to an example embodiment of the present invention is described.

In FIG. 1, the image forming apparatus 100 includes a photoconductive drum 1, a drum cleaning unit 2, a charging unit 4, an optical writing unit 5, and a developing unit 6.

The photoconductive drum 1 is a hollow shaped image bearing member, and is rotated in a clockwise direction in FIG. 1. The photoconductive drum 1 is surrounded by image forming components such as the drum cleaning unit 2, the charging unit 4, the developing unit 6, and so forth.

The drum cleaning unit 2 includes a cleaning blade 3 that is formed of an elastic member such as a rubber member. The drum cleaning unit 2 removes residual toner remaining on a surface of the photoconductive drum 1 after a toner image formed on the surface of the photoconductive drum 1 is transferred onto a recording medium.

The charging unit 4 uniformly charges the surface of the photoconductive drum 1.

The optical writing unit 5 emits a laser light beam toward the photoconductive drum 1 to irradiate the surface of the photoconductive drum 1 so that an electrostatic latent image can be formed on the surface of the photoconductive drum 1.

The developing unit 6 supplies toner onto the photoconductive drum 1 so that the electrostatic latent image formed on the surface of the photoconductive drum 1 can be developed into a visible toner image. The developing unit 6 employs a reversal development method. The toner accommodated in the developing unit 6 is a two-component, non-magnetic toner that is charged to a negative polarity.

In the first example embodiment, the photoconductive drum 1 is an organic photoconductive element having an outer diameter of approximately 40 mm. The photoconductive drum 1 has a peripheral velocity of approximately 150 mm/sec and is rotated by a main motor (not shown) at a constant speed in the clockwise direction in FIG. 1. It should be noted that the values described above are specific examples of the outer diameter and peripheral velocity of the photoconductive drum 1, and therefore, the outer diameter and peripheral velocity of the photoconductive drum 1 according to the first example embodiment of the present invention are not limited to the above-described values.

In the first example embodiment, the charging unit 4 is held in contact with the photoconductive drum 1 and is rotated with the rotation of the photoconductive drum 1. When a high-voltage power supply (not shown) for the charging unit 4 applies an alternating and direct current bias to the charging unit 4, the surface of the photoconductive drum 1 can uniformly be charged to −500V. The optical writing unit 5 irradiates the charged surface of the photoconductive drum 1 to form an electrostatic latent image, and the developing unit 6 supplies toner to the surface of the photoconductive drum 1 for forming a toner image based on the electrostatic latent image. In the example embodiments of the present invention, it is preferable to use a polymerized toner prepared by a polymerization method.

It is preferable that a shape factor "SF-1" of the toner used in the developing unit 6 of the present invention is in a range from approximately 100 to approximately 180, and the shape factor "SF-2" of the toner is in a range from approximately 100 to approximately 180.

Figure 2:
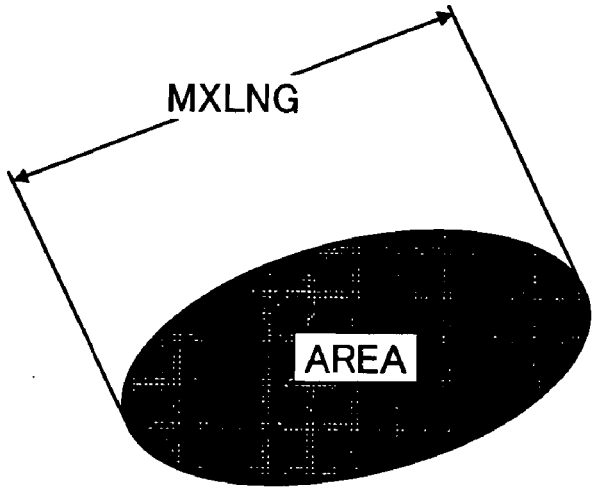
FIG. 2 is a schematic view showing an exemplary toner shape having SF-1 shape according to the first example embodiment of the present invention.

Referring to FIG. 2, the shape factor "SF-1" is a respective parameter representing the roundness of a particle.

The shape factor "SF-1" of a particle is calculated by a following Equation 1:

$$SF1=\{(MXLNG)^2/\mathrm{AREA}\}\times(100\pi/4) \qquad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 3:
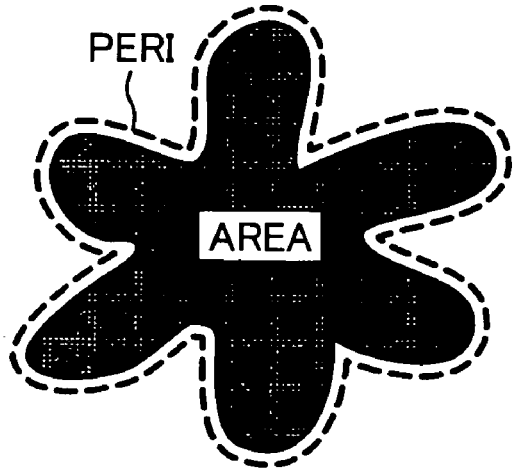
FIG. 3 is a schematic view showing an exemplary toner shape having an SF-2 shape according to the first example embodiment of the present invention.

Referring to FIG. 3, the shape factor "SF-2" is a value representing irregularity (i.e., a ratio of convex and concave portions) of the shape of the toner. The shape factor "SF-2" of a particle is calculated by a following Equation 2:

$$SF2=\{(PERI)^2/\mathrm{AREA}\}\times(100\pi/4) \qquad \text{Equation 2,}$$

where "PERI" represents the perimeter of a figure obtained by projecting a toner particle on a two dimensional plane.

When the value of the shape factor "SF-2" is 100, the surface of the toner is even (i.e., with no convex and concave portions). As the value of the "SF-2" increases, the surface of the toner becomes uneven (i.e., the number of convex and concave portions increase).

In this exemplary embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As a toner particle has a higher degree of roundness, the toner particle is more likely to point-contact with another toner particle or the photoconductive drum 1. In this case, the adhesion force between these toner particles is weak, thereby making the toner particles highly flowable. Also, while weak adhesion force between the round toner particle and the photoconductive element 1 enhances the transfer rate, the round toner is more likely to cause cleaning malfunctioning for blade type cleaning. It is noted that large SF-1 and SF-2 values may deteriorate visual quality of an image due to scattered toner particles on the image. For example, if one of the shape factors "SF-1" and "SF-2" exceeds 180, the transfer rate may deteriorate. Further, the cleaning ability may deteriorate when the toner adheres on a transfer unit. For this reason, it is preferable that the SF-1 and SF-2 values be less than 180.

Further, the desirable volume average particle diameter of the toner used in the first example embodiment of the present invention is in a range of approximately 4 μm to approximately 10 μm.

When the volume average particle diameter of the toner is smaller than 4 μm, background contamination may occur at the time of development, and a blank image (i.e., some portions of the image are dropped) is likely to occur because fluidity of toner is typically degraded and thereby the toner is likely to be aggregated in the developing unit. On the contrary, if the volume average particle diameter of the toner exceeds 10 μm, toner scattering may occur at the periphery of the image, and a precise image may not be obtained due to a low resolution of the image. Therefore, the toner having the volume average particle diameter of 6.5 μm is employed in the image forming apparatus according to the first example embodiment of the present invention.

The image forming apparatus 100 of the first example embodiment further includes a sheet feeding roller 26, a sheet conveying roller 27, a pair of registration rollers 28, a fixing unit 30, a sheet feeding tray 31, a high-voltage power supply 100V, a power supply control unit 101, and a sheet width detecting unit 110.

A transfer sheet 25 accommodated in the sheet feeding tray 31 is fed by the sheet feeding roller 26, and is conveyed via the sheet conveying roller 27 to the pair of registration rollers 28. The transfer sheet 25 is stopped at the pair of registration rollers 28 until a toner image is formed on the surface of the photoconductive drum 1. When the toner image formed on the surface of the photoconductive drum 1 reaches a transfer nip portion that is formed between a transfer roller 21 serving as a transfer unit and the photoconductive drum 1, the pair of registration rollers 28 further feeds the transfer sheet 25 to the transfer nip portion in synchronization with a movement that the toner image is conveyed.

The width of the transfer sheet 25, which is a distance extending in a direction perpendicular to a sheet conveyance direction, is previously detected by the sheet width detecting unit 110 provided in and connected to the sheet feeding tray 31. The sheet width detecting unit 110 serves as a detecting unit to detect a width of the transfer sheet 25 in a sheet conveyance direction when the transfer sheet 25 is placed at a position sandwiched by a pair of fences for aligning or measuring the width of the transfer sheet 25 or when an operator inputs the size of the transfer sheet 25 from an operation panel (not shown) or a sheet width data specifying unit (not shown).

The sheet width detecting unit 110 is connected to a CPU (Central Processing Unit) 120 that is a control unit connected to a memory 130 that is a storing unit. When the sheet width detecting unit 110 detects the width of the transfer sheet 25, the information obtained by the sheet width detecting unit 110 is sent to the CPU 120. The CPU 120 performs a comparison to compare the width of the transfer sheet 25 to be processed with the widths of transfer sheets previously processed. Data regarding the widths of the previously processed transfer sheets is stored in the memory 130 so that the CPU 120 can perform the comparisons by referring to the data store in the memory 130.

The memory 130 can be a RAM (Random Access Memory) or an EEPROM (Electrically Erasable Programmable Read-Only Memory). In the first example embodiment of the present invention, an EEPROM is preferably used.

The memory 130 also stores the number of transfer sheets that are output from the image forming apparatus 100. When a transfer sheet is printed and output, a counter (not show) is provided at a discharging portion (not shown) of the image forming apparatus 100 increments or counts up by one sheet unit. When a transfer sheet passes the discharging portion, the result of a counting operation performed by the counter is sent to the memory 130, or the EEPROM in this case, so that the memory 130 can store the data for controlling a cleaning operation of the transfer roller 21.

The memory 130 sends the data of the number of printout sheets to the CPU 120 so that the CPU 120 can refer to the data when determining whether the cleaning operation is performed, based on the width of the transfer sheet 25 obtained by the sheet width detecting unit 110 and the number of printout sheets stored in the memory 130.

The high-voltage power supply 100V serves as a bias applying unit, and applies a bias voltage for transfer, which has an opposite polarity of the toner, to the transfer roller 21 so that the toner image formed on the surface of the photoconductive drum 1 can be transferred onto the transfer sheet 25. Then, the transfer sheet 25 having the toner image thereon is fixed by the fixing unit 30, and is discharged to a discharge tray (not shown). At this time, the counter counts the output transfer sheet in increments of one.

The high-voltage power supply 100V also applies a bias voltage having an opposite polarity of the above-described bias voltage so as to remove residual developer or toner adhered on the surface of the transfer roller 21 to the surface of the photoconductive drum 1, which is the cleaning operation of the transfer roller 21.

The transfer roller 21 is covered with a surface layer including an elastic member, for example, an elastomer including urethane rubber. The elastic member has a resistance controlled by a conductive material in a range of approximately $10^6$ Ω to approximately $10^{10}$ Ω, and a hardness of approximately 40 degrees, which is measured by ASKER C.

The resistivity of the transfer roller 21 is calculated by the value of the electric current passing at the time of applying the voltage of 1000V across a metal shaft of the transfer roller 21 and a conductive metal plate on which the transfer roller 21 is mounted, on the condition that the load of total 9.8N is imposed on both end portions of the metal shaft (respectively, 4.9N at one side). An equation, Equation 3, is expressed as follows:

$$R(\Omega)=1000(V)/\text{a current value}(A) \qquad \text{Equation 3,}$$

where "R" represents resistivity of the transfer roller 21, "V" represents a voltage applied, and "A" represents a current value when the voltage is applied.

The power supply control unit 101 performs a bias switching operation in which a bias voltage for transfer, which has an opposite polarity to a bias voltage applied to the toner (hereinafter, referred to as a "transfer bias") and another bias voltage for cleaning, which has an same polarity as the bias voltage applied to the toner (hereinafter, referred to as a "cleaning bias") are switched. The power supply control unit 101 also controls the values of the bias voltages. The transfer bias is a variable constant-current power supply, and the value of the transfer bias is set to 8 μA when the cleaning operation is performed. The cleaning bias uses a variable constant-current power supply, and the value of the cleaning bias is set to −1500V.

In the first exemplary embodiment of the present invention, the cleaning operation of the transfer roller 21 is performed at the following respective modes of cleaning timings.

[Modes of Cleaning Timings]

Mode 1: During a warm-up time after the power supply is turned on;

Mode 2: During a warm-up time when resuming the image forming operation after a recovery from a paper jam or after an emergency stop;

Mode 3: At a start time of an image forming operation; and

Mode 4: At an end time of an image forming operation.

Details of the cleaning operations performed at the above-described modes of the cleaning timings are described.

The cleaning operation of the cleaning timing mode 1, which is performed during a warm-up time after the power supply is turned on, is described as follows.

When a power supply of the image forming apparatus 100 is turned on, the image forming apparatus 100 is started so as to warm up. After a warm-up time for an initial power-on of the image forming apparatus 100, the fixing unit 30 is heated to a predetermined temperature, and thereafter, a drive motor (not shown) starts to drive the photoconductive drum 1 to rotate. After a predetermined period of time elapsed, the cleaning bias is firstly applied to the transfer roller 21 to remove residual toner and clean the transfer roller 21, and the transfer bias is then applied to the transfer roller 21. More specifically, the cleaning bias is constantly applied while the transfer roller 21 is rotated for three cycles, and consequently, the transfer bias is continuously applied while the transfer roller 21 is rotated for one cycle.

Next, the cleaning operation of the setting timing mode 2, which is performed during a warm-up time when resuming the image forming operation after a recovery from a paper jam or after an emergency stop, is described.

When a paper jam occurs or after the image forming operation stops due to error detection, the image forming apparatus 100 is warmed up again. While the image forming apparatus 100 is warmed up or during a warm-up time for resuming the image forming apparatus 100, the cleaning operation is performed. The cleaning operation performed in the cleaning timing mode 2 is a similar operation to the cleaning operation in the cleaning timing mode 1, except for an operation for the paper jam. When the paper jam occurs, a great amount of toner may adhere on a surface of the transfer roller 21. Therefore, in the cleaning operation in the first example embodiment, the transfer roller 21 may be rotated for six cycles when applying the cleaning bias, and for two cycles when applying the transfer bias.

Figure 4:
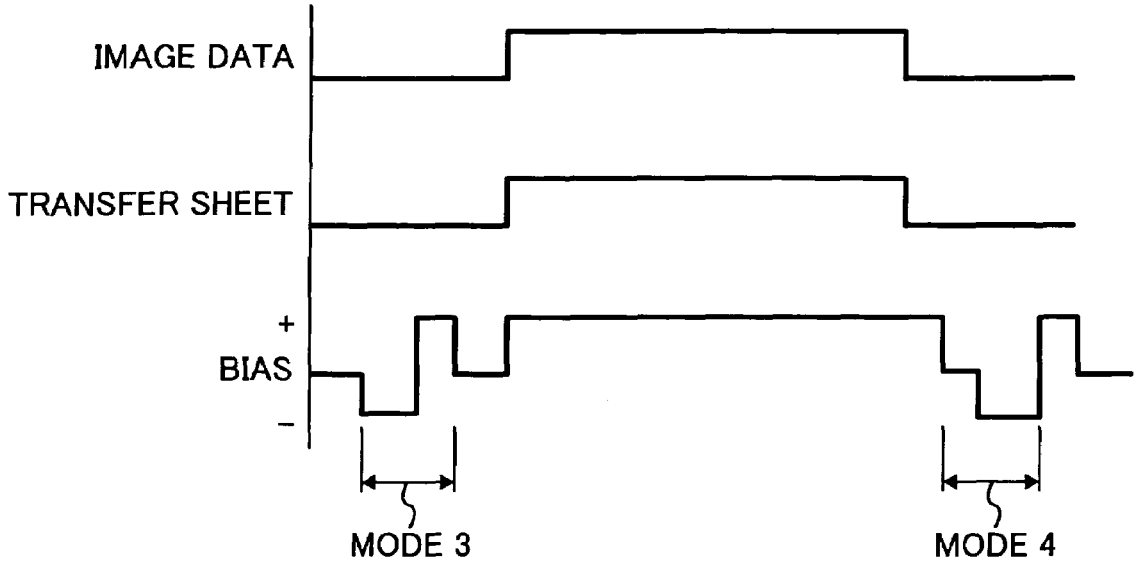
FIG. 4 is a timing chart showing timings at the start and end of an image forming operation according to the first example embodiment of the present invention.

Referring to FIG. 4, the cleaning operations of the cleaning timing modes 3 and 4 are described. FIG. 4 is a graph showing respective timings to perform the cleaning operations of the transfer roller 21 at the start and end of the image forming operation.

The cleaning operation of the cleaning timing mode 3, which is performed at a start time of an image forming operation, is now described.

To start an image forming operation, a main motor (not shown) of the image forming apparatus 100 is turned on. The charging unit 4 uniformly charges a surface of the photoconductive drum 1, and the optical writing unit 5 emits a laser beam to irradiate the surface of the photoconductive drum 1 so that an electrostatic latent image on the surface of the photoconductive drum 1 is formed according to image data. The developing unit 6 supplies toner on the electrostatic latent image to form a toner image.

Now, after the main motor of the image forming apparatus 100 is turned on, the transfer roller 21 is applied with the cleaning bias so that the cleaning operation of the transfer roller 21 can be performed. While the transfer roller 21 is rotated for two cycles, the cleaning bias is applied to the transfer roller 21. Subsequently, while the transfer roller 21 is rotated for one cycle, the transfer bias is applied to the transfer roller 21. After that, the transfer roller 21 has applied thereof a transfer bias of 12 μA in synchronization with a movement of the transfer sheet 25 conveyed to a nip portion of the transfer roller 21. Thus, the toner image formed on the surface of the photoconductive drum 1 is transferred onto the transfer sheet 25.

The cleaning operation of the cleaning timing mode 4, which is performed at an end time of an image forming operation, is described.

After the transfer sheet 25 has passed a transfer nip portion of the transfer roller 21, the transfer bias is turned off. When a predetermined period of time has elapsed after the transfer bias is turned off, the cleaning bias is applied to the transfer roller 21 while the transfer roller 21 is rotated for two cycles, and subsequently, the transfer bias is applied to the transfer roller 21 while the transfer roller is rotated for one cycle.

The toner adhered on the surface of the transfer roller 21 may be a fog toner transferred from the surface of the photoconductive drum 1, which results in the production of a foggy image. The production of fog toner causing a foggy image can be determined based on a relationship between a length of the transfer roller 12 in an axial or longitudinal direction thereof and a width of the transfer sheet 25 in a direction perpendicular to the sheet conveyance direction.

Figure 5:
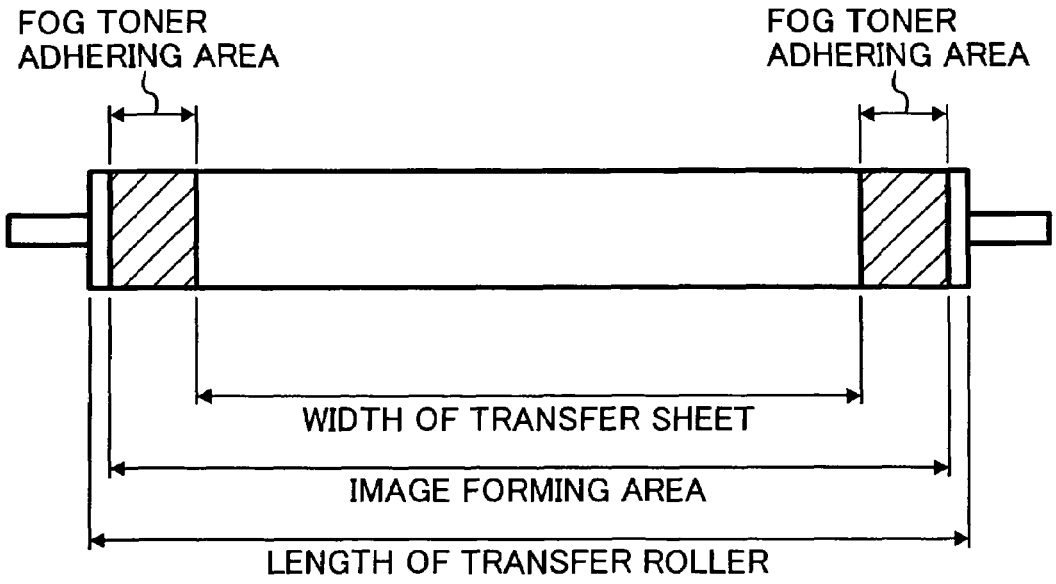
FIG. 5 is a side view of a transfer roller having toner fogging thereon, according to the first example embodiment of the present invention.

Referring to FIG. 5, a schematic structure of the transfer sheet 25 is described.

In FIG. 5, the relationship between the axial length of the transfer roller 12 and the width of the transfer sheet 25 is described.

As shown in FIG. 5, the narrower the width of the transfer sheet 25 becomes, the greater the width of fog toner to be adhered on the transfer roller 21 may be. More specifically, when a transfer sheet having a narrow width is processed before a transfer sheet having a greater width is transferred, the toner adhered on the transfer roller 21 may be transferred onto a back side surface of the transfer sheet 25 so that the back side surface of the transfer sheet 25 may be contaminated by the fog toner.

Figure 6:
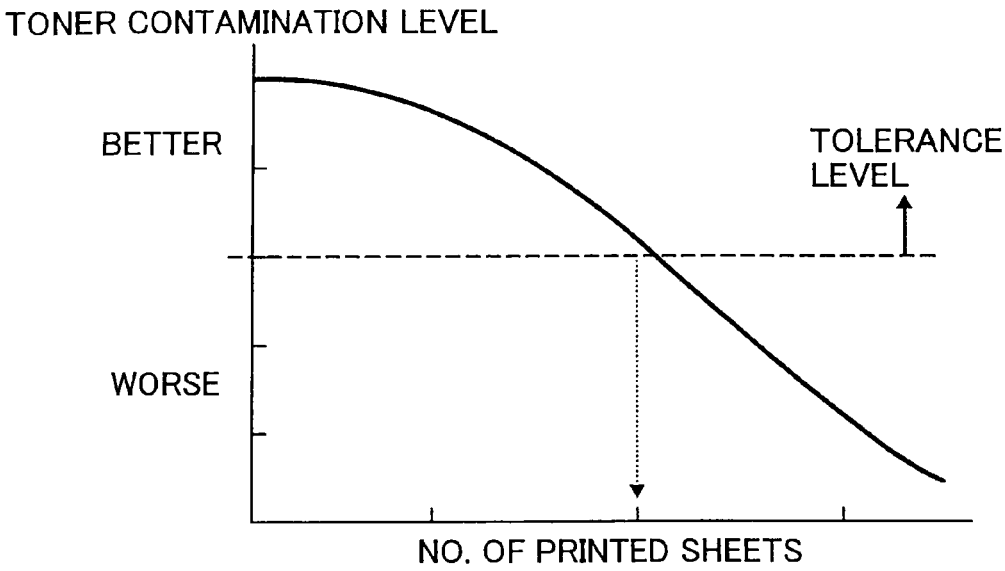
FIG. 6 is a graph showing a relationship of the number of total printed sheets and toner contamination formed on a rear side of a sheet, according to the first example embodiment of the present invention.

Referring to FIG. 6, a relationship of the number of printout sheets and a toner contamination level on the back side of a transfer sheet according to the first example embodiment of the present invention is described.

As shown in FIG. 6, when twenty (20) or more sheets of the transfer sheets 25 are transferred, the level of the back side contamination of the transfer sheet 25 may exceed a tolerance level.

For the above-described reasons, it is preferable that the cleaning operation be performed in the cleaning timing modes 3 and 4 among the above-described cleaning timing modes in the first example embodiment. The cleaning operation is controlled as described below.

The width of the transfer sheet 25 previously recognized by the CPU 120 and the maximum width of image forming area of the image forming apparatus 100 stored in the memory 130, which is 297 mm in the first example embodiment, are compared.

When the width of the transfer sheet 25 is equal to the maximum width of image forming area of the image forming apparatus 100, the cleaning operation is performed in one or none of the cleaning timing mode 4 after the transfer operation and the cleaning timing mode 3 before the next image forming operation.

When the width of the transfer sheet 25 is smaller than the maximum width of image forming area of the image forming apparatus 100 and the number of printout sheets of each job is more than 20 sheets, the cleaning operation is performed in one or both of the cleaning timing mode 4 after the transfer operation and the cleaning timing mode 3 before a next image forming operation.

As described above, by controlling the cleaning operation of the transfer roller 21, the total period of time taken for the cleaning operation of the transfer roller 21 in one or both of the cleaning timing modes 3 and 4 can be reduced and the toner contamination on the back side of the transfer sheet 25 can be reduced or prevented. Further, the number of rotations in the respective drive units in the image forming apparatus 100 can be reduced. Thus, the life of the image forming apparatus 100 can be extended or become longer, and the noise caused by the operations of the image forming apparatus 100 can be reduced.

Second Exemplary Embodiment

Figure 7:
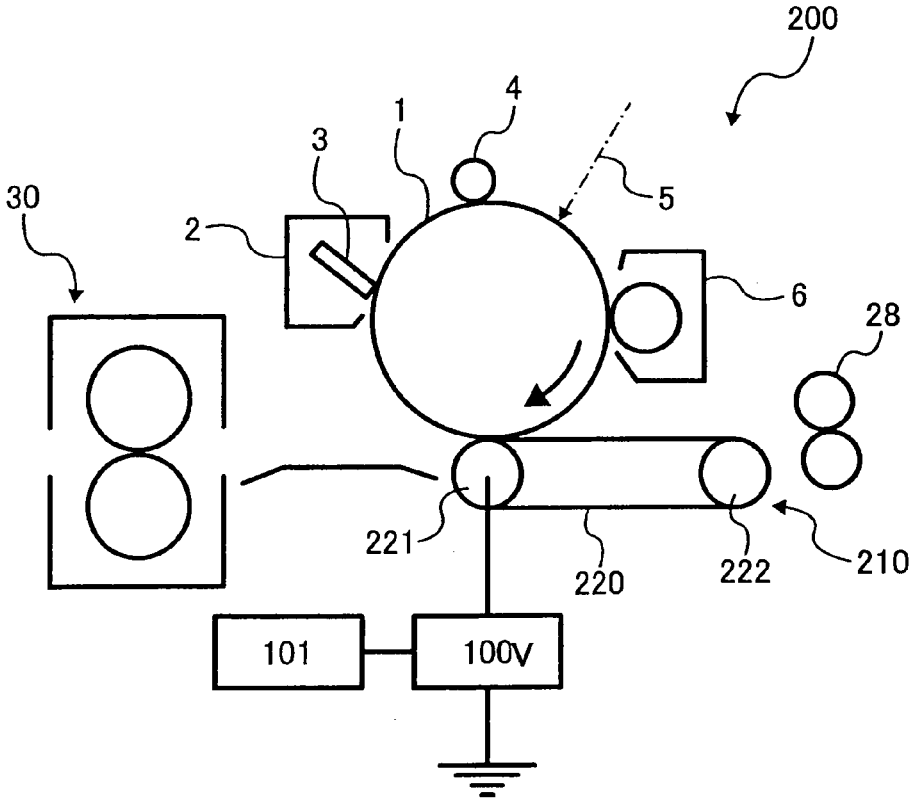
FIG. 7 is a schematic structure of an image forming apparatus according to a second example embodiment of the present invention.

Referring to FIG. 7, a schematic structure of an image forming apparatus 200 according to a second example embodiment of the present invention is described.

The structures and controls of the second example embodiment are similar to those of the first example embodiment, except that a transfer belt serving as a transfer member is used in the second example embodiment. Therefore, the description of the image forming components that have the same structures and functions as those employed in the first example embodiment is omitted here.

In FIG. 7, the image forming apparatus 200 includes a transfer mechanism 210.

The transfer mechanism 210 includes a transfer belt 220, a drive bias roller 221, which is a transfer roller serving as a transfer unit, and a driven roller 222. The transfer belt 220 is spanned around or surrounded by the drive bias roller 221 and the driven roller 222.

After the transfer sheet 25 is conveyed by the transfer belt 220 to a transfer nip portion formed between the photoconductive drum 1 and the drive bias roller 221, a toner image formed on a surface of the photoconductive drum 1 is transferred onto the transfer sheet 25 by a transfer bias applied to the drive bias roller 221, and then is fixed by the fixing unit 30.

In the image forming apparatus 200 using the transfer belt 220 as described in the second example embodiment, same control operations may be performed as those performed in the first example embodiment. Thus, the total period of time taken for the cleaning operation of the transfer belt 220 in one or both of the cleaning timing modes 3 and 4 can be reduced and the toner contamination on the back side of the transfer sheet 25 can be reduced or prevented.

Third Exemplary Embodiment

Figure 8:
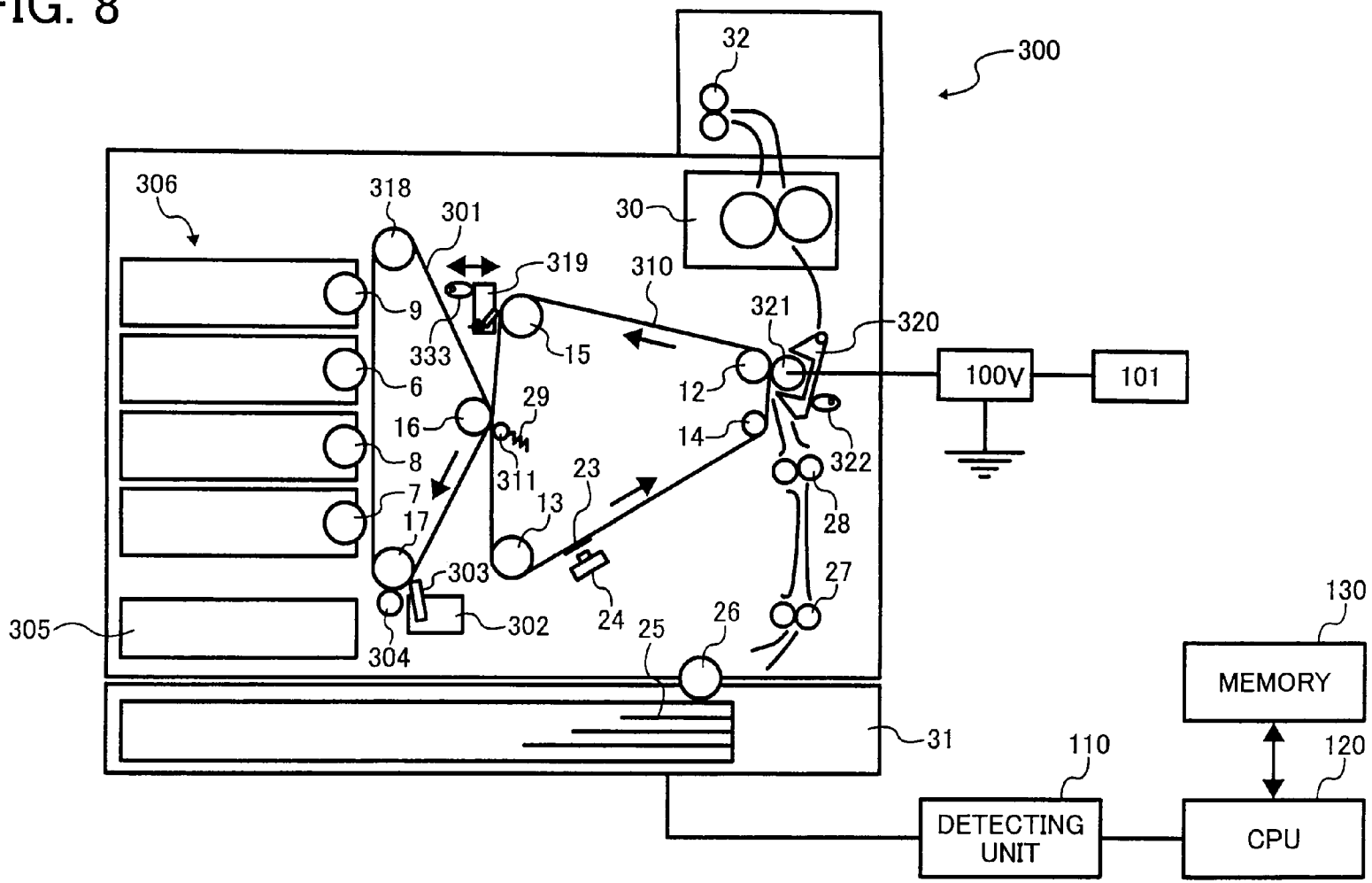
FIG. 8 is a schematic structure of a full color image forming apparatus according to a third example embodiment of the present invention.

Referring to FIG. 8, a schematic structure of an image forming apparatus 300 according to a third example embodiment of the present invention is described.

The structures and functions of the image forming components used in the third example embodiment are similar to those of the first example embodiment, except that the image forming apparatus 300 of the third example embodiment of the present invention includes a color image forming apparatus having an intermediate transfer member. Therefore, the description of image forming components that have same structures and functions in the first example embodiment is omitted here.

In FIG. 8, the image forming apparatus 300 includes a photoconductive belt 301, and an intermediate transfer belt 310.

The photoconductive belt 301 is passed over or spanned around an opposed primary transfer roller 16, a drive roller 17, and a driven roller 318, in a form of an endless belt. Image forming components such as a belt cleaning unit 302, a charging unit 304, an optical writing unit 305, a plurality of developing units 306, and the intermediate transfer belt 310 are disposed around a photoconductive belt 301 serving as an image bearing member.

The charging unit 304 has the same structure and function as the charging unit 4, and the optical writing unit 305 has a same structure and function as the optical writing unit 5.

The plurality of developing units 306 includes four developing units that are a developing unit for a yellow image 6, a developing unit for a magenta image 7, a developing unit for a cyan image 8, and a developing unit for a black image 9. When forming a full color image, respective toner images are formed in the order by the developing unit for a yellow image 6, the developing unit for a magenta image 7, the developing unit for a cyan image 8, and the developing unit for a black image 9. Subsequently, the respective toner images are sequentially transferred and overlaid on a surface of the intermediate transfer belt 310 so that a full color image can be formed.

In FIG. 8, the belt cleaning unit 302 removes residual toner remaining on the surface of the photoconductive belt 301 with a cleaning blade 303.

The intermediate transfer belt 310 is passed over or spanned around a primary transfer bias roller 311 serving as a transfer unit, an opposed secondary transfer roller 12, a drive roller 13, a tension roller 14, and an opposed cleaning roller 15. The intermediate transfer belt 310 is driven by a drive motor (not shown).

The primary transfer bias roller 311 is pressed by a pressure spring 29 toward the opposed primary transfer roller 16 sandwiching the photoconductive belt 301.

The color image forming apparatus 300 further includes side plates (not shown). The side plates are disposed front and rear side of the color image forming apparatus 300 so as to support both ends of the above-described respective rollers provided in the color image forming apparatus 300.

The intermediate transfer belt 310 includes a single layer or a plurality of layers formed by a resin, for example, PVDF (polyvinylidene fluoride), TEFE (ethylene-tetrafluoroethylene copolymer), PI (polyimide), PC (polycarbonate), and so forth, dispersed by a conductive material for example carbon black, and is controlled to have a volume resistivity in a range of approximately from $10^8$ Ωcm to approximately $10^{12}$ Ωcm, and a surface resistivity in a range of approximately from $10^8$ Ωcm to approximately $10^{15}$ Ωcm.

When needed, the surface of the intermediate transfer belt 310 can be formed by a coating applying a mold releasing agent. Specific examples of the mold release agent employable herein include fluororesin such as ETFE (ethylene-tetrafluoroethylene copolymers), PTFE (polytetrafluoroethylene), PVDF (polyvinylidene fluoride), PEA (perfluoroalkoxy fluororesin), FEP (tetrafluoroethylene-hexafluoropropylene copolymers), PVF (polyvinylfluoride), etc. However, the mold release agent is not limited to the above-described fluororesin.

The intermediate transfer belt 310 is produced in a shape of an endless belt by a molding method such as a cast molding method and a centrifugal molding method. When needed, after the intermediate transfer belt 310 is molded by the above-described molding method, the surface of the intermediate transfer belt 310 can be polished.

If the volume resistivity and the surface resistivity of the intermediate transfer belt 310 respectively exceed the above-described ranges, a bias voltage necessary for the primary transfer and the secondary transfer rises up. As a result, the cost of electric power consumption increases. In addition, because the charging electric potential of the intermediate transfer belt 310 becomes high in a transfer process and in a transfer sheet separating process and a self-discharge becomes hard to be performed, it may be necessary to provide a charge-removing unit.

On the contrary, if the volume resistivity and the surface resistivity of the intermediate transfer belt 310 respectively fall below the above-described ranges, because a charging electric potential of the intermediate transfer belt 310 is attenuated quickly, the removal of the charge by a self-discharge is easily performed. However, because electric current passes in a radial direction of the surface of the intermediate transfer belt 310 at the time of transfer, toner scattering may occur at the periphery of the image.

For the above-described reasons, when the intermediate transfer belt 310 is used for the present invention, it is preferable that the volume resistivity and the surface resistivity of the intermediate transfer belt 10 be within the above-described respective ranges. The intermediate transfer belt 310 in the third example embodiment employs a single layer including a material such as PI (polyimide) added with carbon black, and a thickness thereof is controlled to approximately 100 μm.

For measuring the volume resistivity and the surface resistivity of the intermediate transfer belt 310, the resistance meter (Hiresta IP, available from Mitsubishi Chemical Corporation) to which an HRS probe (with a diameter of the inner-side electrode of 5.9 mm and an inside diameter of the ring electrode of 11 mm) had been connected, was used. As the volume resistivity of the intermediate transfer belt 310, the current value measured by the above-described resistance meter ten seconds after applying the voltage of approximately 100V across the front and rear surfaces of the intermediate transfer belt 310 was employed. As the surface resistivity of the intermediate transfer belt 310, the current value measured by the above-described resistance meter ten seconds after applying the voltage of 500V across the front and rear surfaces of the intermediate transfer belt 310 was employed.

The image forming apparatus 300 of the third example embodiment further includes a belt cleaning unit 319 and a secondary transfer unit 320.

The belt cleaning unit 319 is detachably attached to the intermediate transfer belt 310 and includes a contact and separation mechanism 333. The contact and separation mechanism 333 contacts and separates the belt cleaning unit 319 with respect to the intermediate transfer belt 310. For example, after a yellow toner image that is a first toner image is transferred onto the surface of the intermediate transfer belt 310, a magenta toner image as a second toner image, a cyan toner image as a third toner image, and a black toner image as a fourth toner image are sequentially transferred onto the surface of the intermediate transfer belt 310. While the respective color toner images are being transferred onto the intermediate transfer belt 310, the contact and separation mechanism 333 separates the belt cleaning unit 319 from the surface of the intermediate transfer belt 310. After a secondary transfer operation is performed, the contact and separation mechanism 333 presses the belt cleaning unit 319 to contact with the surface of the intermediate transfer belt 310 at a predetermined timing so that residual toner can be removed from the surface of the intermediate transfer belt 310. A belt position detection mark 23 is formed at the end portion of the intermediate transfer belt 310, and a mark sensor 24 detects the mark 23. The image forming process of respective colors is started at a timing in which the mark sensor 24 detects the belt position detection mark 23, thereby the respective color images can be overlaid on a proper position.

The secondary transfer unit 320 includes a secondary transfer bias roller 321 serving as a transfer unit and a contact and separation mechanism 322.

The contact and separation mechanism 322 controls a contact and separation operation of the secondary transfer bias roller 321 to contact and separate the secondary transfer bias roller 321 with respect to the intermediate transfer belt 310.

The secondary transfer bias roller 321 used in the third example embodiment of the present invention includes a metal shaft made of, for example, stainless steel (SUS), etc. An elastic member, for example, urethane rubber whose resistivity is controlled by conductive materials to be from approximately $10^6$ Ω to approximately $10^{10}$ Ω, etc. is formed around the circumference of the metal shaft.

If the resistivity of the secondary transfer bias roller 321 exceeds $10^{10}$ Ω, electric current becomes hard to pass. Therefore, in order to obtain a required transfer performance of the secondary transfer bias roller 321, it is required to apply a high voltage to the secondary transfer bias roller 321. As a result, the cost of electric power consumption increases. Further, if such a high voltage is applied to the secondary transfer bias roller 321, discharge occurs at the space in the upstream and downstream sides of a nip portion between the intermediate transfer belt 310 and the secondary transfer bias roller 321 in the secondary transfer area. Consequently, several blank portions occur on the discharged portion of the halftone image.

If the resistivity of the secondary transfer bias roller 321 is less than $10^6$ Ω, a multi-color toner image portion (e.g., a three-color toner image) and a single-color toner image portion that exist on the same image cannot be collectively transferred onto the transfer sheet 25.

Specifically, in this case, although electric current sufficient for transferring the single-color toner image portion onto the transfer material at relatively low voltage can pass through the secondary transfer bias roller 321, voltage higher than an optimal voltage for transferring the single-color toner image portion onto the transfer material becomes necessary for transferring the multi-color toner image portion onto the transfer material. Accordingly, if the applying voltage to the secondary transfer bias roller 321 is set to an amount that allows the multi-color toner image portion to transfer onto the recording medium, a transfer electric current applied to the single-color toner image portion becomes excessive. As a result, the efficiency in the secondary transfer may be decreased.

The resistivity of the secondary transfer bias roller 321 is calculated by the value of the electric current passing at the time of applying the voltage of 1000V across the metal shaft of the secondary transfer bias roller 321 and a conductive metal plate on which the secondary transfer bias roller 321 is mounted, on the condition that the load of total 9.8N is imposed on both end portions of the metal shaft (respectively, 4.9N at one side).

The secondary transfer bias roller 321 is driven via a driving gear (not shown). The circumferential velocity of the secondary transfer bias roller 321 is controlled to be substantially the same as that of the intermediate transfer belt 310 so as to avoid slippage between the secondary transfer bias roller 321 and the intermediate transfer belt 310.

The secondary transfer bias roller 321 is normally separate from the intermediate transfer belt 310 by the contact and separation mechanism 322. However, when a complete toner image (a four-color toner image in this case) on the surface of the intermediate transfer belt 310 is to be transferred to an image transfer position of the transfer sheet 25, the circumferential surface of the secondary transfer bias roller 321 is pressed against the rear surface of the transfer sheet 25 by the contact and separation mechanism 322 with an appropriate timing. Subsequently, a predetermined bias voltage is applied to the secondary transfer bias roller 321 from a high voltage power supply 100, and thereby the toner image is collectively transferred onto the transfer sheet 25.

The transfer sheet 25 is fed via a sheet feeding roller 26, a sheet conveying roller 27, and a pair of registration rollers 28 into a secondary transfer position in synchronization with the arrival of the leading edge of the toner image on the intermediate transfer belt 310 to the secondary transfer position. The transfer sheet 25 with the four color toner image transferred thereon is fixed to the transfer sheet 25 by a fixing device 30. Finally, the transfer sheet 25 is discharged via a sheet discharging roller 32 to a sheet discharging tray (not shown).

The toner used in the image forming apparatus 300 of the third exemplary embodiment has a shape and diameter of a toner particle same as that of the toner used in the first example embodiment. Therefore, a description of the toner for the third example embodiment is omitted.

As performed in the first exemplary embodiment of the present invention, the cleaning operation of the transfer roller (the secondary transfer bias roller 321 in the third example embodiment) is performed in the image forming apparatus 300 of the third exemplary embodiment at respective modes of the following cleaning timings.

[Modes of Cleaning Timings]

Mode 1: During a warm-up time after the power supply is turned on;

Mode 2: During a warm-up time when resuming the image forming operation after a recovery from a paper jam or after an emergency stop;

Mode 3: At a start time of an image forming operation; and

Mode 4: At an end time of an image forming operation.

Since the respective modes are same as those performed in the first exemplary embodiment, the detailed description of the modes is omitted.

Figure 9:
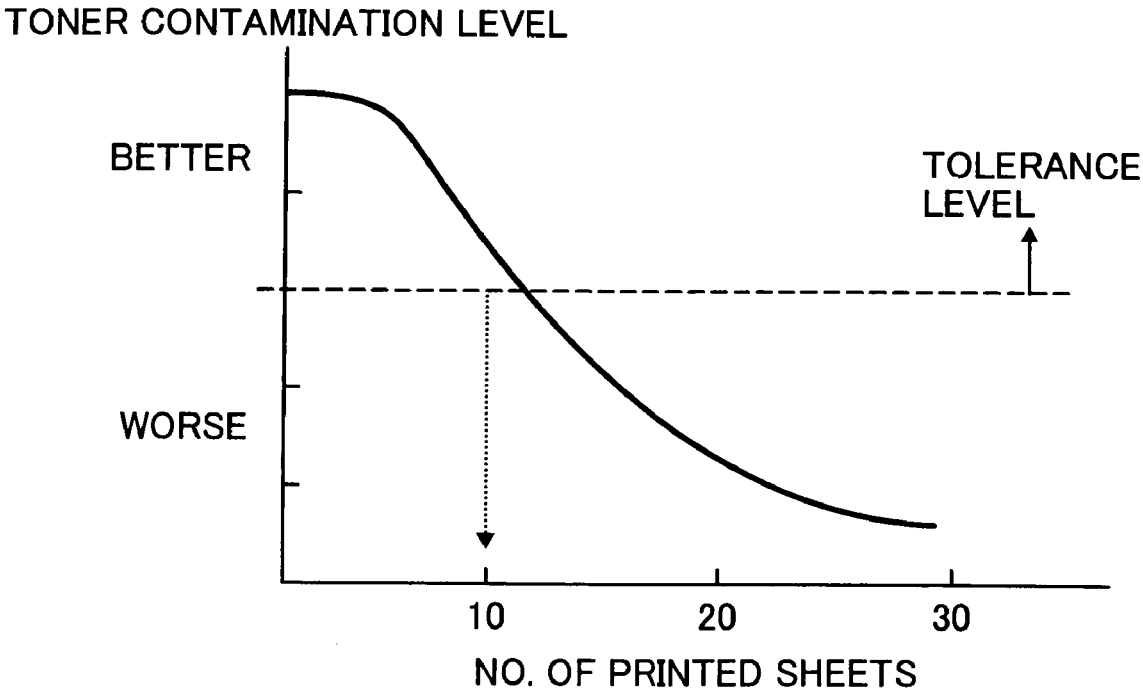
FIG. 9 is a graph showing a relationship of the number of total printed sheets and toner contamination formed on a rear side of a sheet, according to the third example embodiment of the present invention.

Referring to FIG. 9, the relationship of the number of printout sheets and a toner contamination level on the back side of a transfer sheet according to the third exemplary embodiment of the present invention is described.

As shown in FIG. 9, when ten (10) or more sheets of the transfer sheet 25 are transferred, the level of the back side contamination of the transfer sheet 25 can exceed a tolerance level. It is assumed that the reason why the threshold number of printout sheets in the third exemplary embodiment is smaller than the threshold number of printout sheets in the first exemplary embodiment is that the image forming apparatus 300 of the third exemplary embodiment uses four colors of toner.

The cleaning operations performed in the above-described cleaning timing modes 1 through 4 in the third exemplary embodiment of the present invention are similar to the cleaning operations performed in the first exemplary embodiment of the present invention, except that the threshold number of acceptable printout sheets is determined to be ten (10) sheets in the modes 3 and 4.

More specifically, the cleaning operations performed in the cleaning timing modes 3 and 4 are controlled as described below.

The width of the transfer sheet 25 previously recognized by a CPU 120 and the maximum width of image forming area of the image forming apparatus 300 stored in a memory 130, which is 297 mm in the third exemplary embodiment, are compared.

When the width of the transfer sheet 25 is equal to the maximum width of image forming area of the image forming apparatus 300, the cleaning operation is performed in one or none of the cleaning timing mode 4 after the transfer operation and the cleaning timing mode 3 before a next image forming operation.

When the width of the transfer sheet 25 is smaller than the maximum width of image forming area of the image forming apparatus 300 and the number of printout sheets of each job is more than 10 sheets, the cleaning operation is performed in one or both of the cleaning timing mode 4 after the transfer operation and the cleaning timing mode 3 before a next image forming operation.

As described above, by controlling the cleaning operation of the secondary transfer bias roller 321, the total period of time taken for the cleaning operation of the secondary transfer bias roller 321 in one or both of the cleaning timing modes 3 and 4 can be reduced and the toner contamination on the back side of the transfer sheet 25 can be reduced or prevented.

Fourth Exemplary Embodiment

Figure 10:
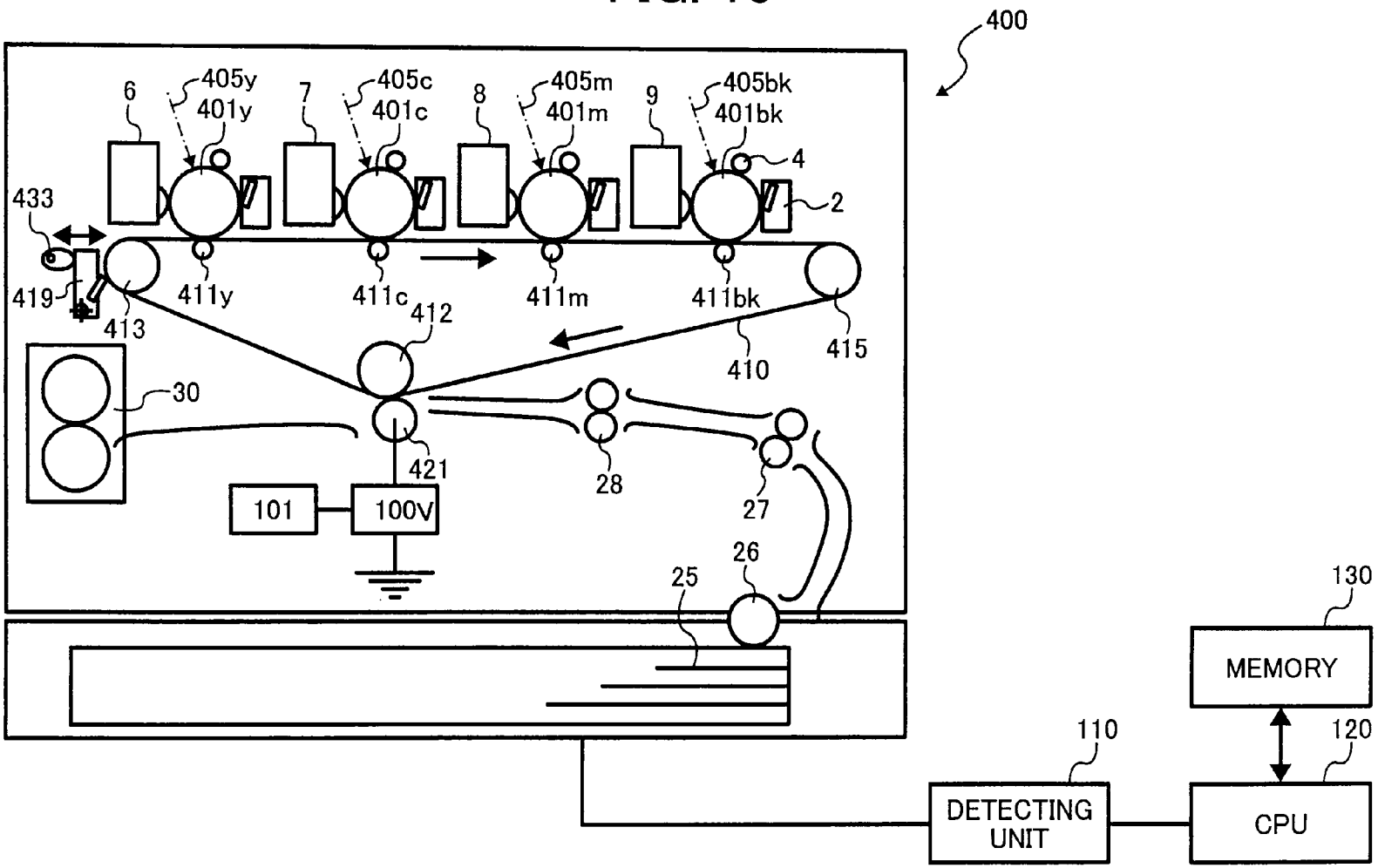
FIG. 10 is a schematic structure of a full color image forming apparatus according to a fourth example embodiment of the present invention.

Referring to FIG. 10, a schematic structure of an image forming apparatus 400 according to a fourth exemplary embodiment of the present invention is described.

The structures and controls of the fourth exemplary embodiment are similar to those of the third exemplary embodiment, except that the image forming apparatus 400 employs a tandem type image forming system in which four photoconductive drums 401*y*, 401*c*, 401*m*, and 401*bk* included in the image forming apparatus 400 are disposed in a horizontal manner for forming a full color image. The photoconductive drums 401*y*, 401*c*, 401*m*, and 401*bk* are arranged according to the order of forming respective toner images, such as a yellow toner image, a cyan toner image, a magenta toner image, and a black toner image.

The image forming apparatus 400 further includes an optical writing unit (not shown), respective developing units 6, 7, 8, and 9, and an intermediate transfer belt 410.

Each of the photoconductive drums 401*y*, 401*c*, 401*m*, and 401*bk* is uniformly charged by a charging unit 4. The optical writing unit emits respective laser beams 405*y*, 405*c*, 405*m*, and 405*bk* according to image data to irradiate respective surfaces of the photoconductive drums 401*y*, 401*c*, 401*m*, and 401*bk* so that respective electrostatic latent images are formed on the photoconductive drums 401*y*, 401*c*, 401*m*, and 401*bk*. The developing units 6, 7, 8, and 9 develop the respective electrostatic latent images into respective visible toner images.

The intermediate transfer belt 410 is passed over or spanned around a plurality of supporting rollers 412, 413, and 415, and forms an endless belt.

The respective toner images are sequentially transferred and overlaid onto a surface of the intermediate transfer belt 410 by applying a predetermined voltage to respective primary transfer roller 411*y*, 411*c*, 411*m*, and 411*bk*, which serve as a transfer unit, so that a full color toner image is formed.

After the toner images on the respective surfaces of the photoconductive drums 401*y*, 401*c*, 401*m*, and 401*bk*, residual toner remaining on each surface of the photoconductive drums 401*y*, 401*c*, 401*m*, and 401*bk* is removed by a drum cleaning unit 2.

The full color toner image formed in the fourth example embodiment is transferred onto a transfer sheet 25 at a secondary transfer nip portion of a secondary transfer bias roller 421 serving as a transfer unit, fixed by a fixing unit 30, and output to a sheet discharging tray (not shown).

While the respective color toner images are being transferred onto the intermediate transfer belt 410, a contact and separation mechanism 433 separates a belt cleaning unit 419 from the surface of the intermediate transfer belt 410. After the fill color toner image is transferred onto the transfer sheet 25, the contact and separation mechanism 433 presses the belt cleaning unit 419 to contact with the surface of the intermediate transfer belt 410 to remove residual toner remaining on the surface of the intermediate transfer belt 410.

While the intermediate transfer belt 310 in the third example embodiment is rotated for a plurality of cycles to form an overlaid color toner image, the intermediate transfer belt 410 in the fourth example embodiment is rotated for one cycle because the plurality of photoconductive drums 401*y*, 401*c*, 401*m*, and 401*bk* can transfer the respective toner images onto the intermediate transfer belt 410 at one time. Thereby, the image forming apparatus 400 of the fourth example embodiment can contribute to high productivity for image forming.

Thus, in forming a full color image having high productivity, the fourth example embodiment of the present invention can reduce the total period of time taken for the cleaning operation of the secondary transfer bias roller 421 in one or both of the cleaning timing modes 3 and 4 can be reduced and the toner contamination on the back side of the transfer sheet 25 can be reduced or prevented.

The fourth exemplary embodiment of the present invention can be applied for respective modes of the cleaning operations performed during the warm-up time after the power supply is turned on and the warm-up time when resuming an image forming operation after a recovery from a paper jam or an emergency stop. Further, since the transfer member is made of a rotatable elastic material such as a roller or a belt, high adhesion of a recording medium and an image bearing member can produce a high quality image without the blank portion or white spots. Further, the toner is prepared by a polymerization method. The toner particles prepared by the method do not have dispersion, which results in production of a high quality image. Further, since the toner has the shape factor SF-2 in a range of approximately 100 to approximately 180, an image having high quality with high transfer efficiency can be obtained.

The cleaning operations of the present invention are not limited to the above-described example embodiments. For example, a belt-type intermediate transfer member is used in the fourth example embodiment. However, a drum-type intermediate transfer member can also be applied to the above-described example embodiments of the present invention. Similarly, an image bearing member can be formed by a belt, a drum, or the like in the above-described example embodiments. However, the present invention can further be applied to an image forming apparatus including a rotative contact transfer member. Further, the above-described example embodiments include an intermediate transfer member or belt having a single layer. However, the present invention can be applied to an intermediate transfer member or belt having a plurality of layers. It is preferable that the intermediate transfer member includes an intermediate transfer belt having a multiple layers. It is more preferable that the intermediate transfer member includes a drum-shaped intermediate transfer member.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

an image bearing member configured to bear an image on a surface thereof;

a transfer unit configured to transfer the image formed on the surface of the image bearing member onto a recording medium;

a bias applying unit configured to apply a bias voltage to the transfer unit to remove a developer adhered on a surface of the transfer unit to the surface of the image bearing member;

a detecting unit configured to detect a width dimension of the recording medium in a sheet conveyance direction; and a control unit configured to determine whether a cleaning operation of the transfer unit is performed, based on a width dimension of the recording medium detected by the detecting unit and a number of the recording medium printed wherein:

the cleaning operation includes a first cleaning operation performed at a start of an image forming operation of a job and a second cleaning operation performed at an end of the image forming operation of the job; and at least one of the first and second cleaning operations is performed when the recording medium has a width smaller than a maximum width of image forming area of the image forming apparatus.

2. The image forming apparatus according to claim 1, wherein:

the transfer unit is configured to contact a back side surface of the recording medium and to be applied with a predetermined amount of bias voltage by the bias applying unit so that the image formed on the surface of the image bearing member is transferred onto a front side surface of the recording medium.

3. The image forming apparatus according to claim 2, wherein:

the transfer unit includes a rotatable elastic roller.

4. The image forming apparatus according to claim 2, wherein:

the transfer unit includes a rotatable endless belt.

5. The image forming apparatus according to claim 2, wherein:

the image bearing member is configures is configured to bear a plurality of images; and the transfer unit comprises:

an intermediate transfer member;

a primary transfer unit configured to sequentially transfer the plurality of images onto a surface of the intermediate transfer member; and a secondary transfer unit configured to contact a back side surface of the recording medium and to be applied with the predetermined amount of bias voltage by the bias applying unit so that the plurality of images transferred and overlaid on the surface of the intermediate transfer member is transferred onto the front side surface of the recording medium.

6. The image forming apparatus according to claim 5, wherein:

said at least one of the first and second cleaning operations is performed for the secondary transfer unit when the recording medium has a width dimension smaller than a maximum width dimension of image forming area of the image forming apparatus.

7. The image forming apparatus according to claim 5, wherein:

the transfer unit includes a rotatable elastic roller.

8. The image forming apparatus according to claim 5, wherein:

the transfer unit includes a rotatable endless belt.

9. The image forming apparatus according to claim 5, wherein:

the image bearing member includes an electrostatic latent image bearing member configured to bear a single toner image; and the intermediate transfer member is configured to be rotated a plurality of times to receive the plurality of images one image after another from the image bearing member so that a full color image is formed thereon.

10. The image forming apparatus according to claim 5, wherein:

the electrostatic latent image bearing member includes a plurality of electrostatic latent image bearing members configured to bear respective single color images so that the full color image is formed on the intermediate transfer member.

11. The image forming apparatus according to claim 5, wherein:

the intermediate transfer member includes an endless belt having single layer thereon.

12. The image forming apparatus according to claim 5, wherein:

the intermediate transfer member includes an endless belt having a plurality of layers thereon.

13. The image forming apparatus according to claim 5, wherein:

the intermediate transfer member includes an intermediate transfer drum.

14. The image forming apparatus according to claim 1, wherein:

the developer comprises a polymerized toner prepared by a polymerization method.

15. The image forming apparatus according to claim 1, wherein:

the developer has a first shape factor SF-1 in a range of approximately 100 to approximately 180 and a second shape factor SF-2 in a range of approximately 100 to approximately 180.

16. An image forming apparatus, comprising:

means for bearing an image on a surface thereof;

means for transferring the image formed on the means for bearing onto a recording medium;

means for applying a bias voltage to the means for transferring and removing a developer adhered on the means for transferring to the means for bearing;

means for detecting a width of the recording medium in a sheet conveyance direction; and means for determining whether a cleaning operation of the means for transferring is performed, based on the width of the recording medium detected by the means for detecting and a number of the recording medium printed wherein:

the cleaning operation includes a first cleaning operation performed at a start of an image forming operation of a job and a second cleaning operation performed at an end of the image forming operation of the job; and at least one of the first and second cleaning operations is performed when the recording medium has a width smaller than a maximum width of image forming area of the image forming apparatus.

17. A method of performing a cleaning operation with respect to a transfer unit, comprising:

detecting a width of a recording medium;

comparing the width of the recording medium with a width previously stored in a memory;

counting the number of the recording medium printed;

determining whether the cleaning operation of the transfer unit is performed, based on results of the comparing and counting;

applying a bias voltage when the cleaning operation is performed according to a result of determining whether the cleaning operation of the transfer unit is performed and performing at least one of a first cleaning operation performed at a start of an image forming operation of a job and a second cleaning operation performed at an end of the image forming operation of the job when the recording medium has a width smaller than a maximum width of image forming area of the image forming apparatus.

* * * * *